US006104354A

United States Patent [19]

Hill et al.

[11] Patent Number: 6,104,354

[45] Date of Patent: Aug. 15, 2000

[54] RADIO APPARATUS

[75] Inventors: Roger Hill, Horley; Philip J. Connor; Robert J. Cox, both of Cambridge, all of United Kingdom

[73] Assignee: U.S. Philips Corporation, New York, N.Y.

[21] Appl. No.: 09/275,363

[22] Filed: Mar. 24, 1999

[30] Foreign Application Priority Data

Mar. 27, 1998 [GB] United Kingdom ..... 9806488

[51] Int. Cl.[7] ..... H01Q 11/12

[52] U.S. Cl. ..... 343/744; 343/748; 343/866

[58] Field of Search ..... 343/741, 742, 343/744, 745, 748, 866, 867, 702; H01Q 11/12

[56] References Cited

U.S. PATENT DOCUMENTS

| | | | |
|---|---|---|---|
| 5,113,196 | 5/1992 | Ponce De Leon et al. | 343/744 |
| 5,422,650 | 6/1995 | Hill | 343/744 |
| 5,469,180 | 11/1995 | Wiggenhorn | 343/744 |
| 5,673,054 | 9/1997 | Hama | 343/744 |
| 5,973,650 | 10/1999 | Nakanishi | 343/744 |
| 5,995,054 | 11/1999 | Massey | 343/744 |
| 6,028,559 | 2/2000 | Satoh et al. | 343/744 |

FOREIGN PATENT DOCUMENTS

| | | | |
|---|---|---|---|
| 61-199303A | 9/1986 | Japan | H01P 3/123 |
| 2227370A | 7/1990 | United Kingdom | H01Q 1/38 |
| WO9115878 | 10/1991 | WIPO | H01Q 7/00 |

*Primary Examiner*—Don Wong
*Assistant Examiner*—Hoang Nguyen
*Attorney, Agent, or Firm*—Jack D. Slobod

[57] ABSTRACT

A small radio apparatus such as a pager has a printed circuit loop antenna(12) comprising a generally elongate loop formed by first and second electrical conductors(22,24) interconnected by first and second electrically conductive end portions(18,20). A fixed value high Q capacitance(26) is incorporated into the first end portion(18) and a variable capacitance(30) is incorporated in a tap(28) interconnecting the first and second conductors(22,24) adjacent to, but spaced from, the second end portion(20). The loop antenna may be fabricated from low loss material or may comprise a track or back-to-back tracks on a dielectric substrate. The loop antenna(12) may be connected directly to RF circuitry or may be coupled inductively to the RF circuitry.

10 Claims, 3 Drawing Sheets

RADIO APPARATUS

BACKGROUND OF THE INVENTION

The present invention relates to a radio apparatus and particularly, but not exclusively, to a physical small apparatus having a loop antenna, for example a pager. The present invention also relates to a loop antenna.

The use of loop antennas in pagers is known and typically the antenna is a strip of metal bent to a desired shape and a single variable capacitor is connected across the ends of the loop for tuning the antenna. Since pagers are intended to be low cost products, component costs are minimised wherever appropriate and low cost variable capacitors have the drawbacks of being generally lossy at the frequencies of interest and can have a poor temperature performance. Further the use of a single variable capacitor for tuning the antenna over a wide frequency range has the disadvantage that the tuning is critical.

SUMMARY OF THE INVENTION

An object of the present invention is to provide a relatively efficient small antenna using low cost components and is relatively easy to tune.

According to one aspect of the present invention there is provided a radio apparatus having an loop antenna comprising a generally elongate loop formed by first and second electrical conductors interconnected by first and second electrically conductive end portions, a fixed value capacitance incorporated into the first end portion, a tap interconnecting the first and second conductors adjacent to, but spaced from, the second end portion and a variable capacitance in said tap.

According to a second aspect of the present invention there is provided a loop antenna comprising a generally elongate loop formed by first and second electrical conductors interconnected by first and second electrically conductive end portions, a fixed value capacitance incorporated into the first end portion, a tap interconnecting the first and second conductors adjacent to, but spaced from, the second end portion and a variable capacitance in said tap.

By using a fixed value capacitor and a remotely located variable capacitance, the tuning of the antenna is dominated by the fixed value capacitance, which has a higher Q than the variable capacitance, producing a restricted tuning range enabling the antenna to be tuned in a less critical manner by the variable capacitance which may be a low cost component. The choice of location of the tap is selected having regard to the criteria that moving the tap towards the fixed value capacitance increases the tuning range but also increases the losses and that moving the tap towards the second end portion decreases the tuning range but leads to an increased efficiency.

The variable capacitance may comprise a mechanically adjustable capacitor or an electrically adjustable capacitance, such as a varactor. Whilst an electrically adjustable capacitance enables the antenna to be tuned to different frequencies, components such as varactors are lossy devices. The lossy effect may be countered by minimising the electrical tuning range in the loop antenna and providing another tap adjacent to, but spaced from, the first mentioned tap, having a mechanically adjustable capacitor with sufficient tuning range to correct variations of resonant frequency due to manufacturing tolerances.

A high value dc blocking capacitor may be incorporated into the second end portion of the antenna and connections to a varactor biasing voltage source are attached to the antenna either side of the blocking capacitor.

A convenient way of making the loop antenna is as an electrically conductive track on an insulating substrate. If it is found that losses in the substrate are unacceptable, a second loop can be provided on the opposite side of the substrate, the second loop including a fixed value capacitance but not having a tap. Any edge effects which produce losses can be countered by interconnecting the loops through the substrate to make a Faraday cage type structure giving no E—field within the structure.

The loop antenna may be generally flat and a convenient method of coupling the antenna to RF components on a printed circuit board (p.c.b.) whilst avoiding losses due to p.c.b. material is to use magnetic loop coupling by means of a loop mounted on the p.c.b. which is adjacent to, but spaced from, the loop antenna.

In an embodiment of the loop antenna which enables direct coupling to the RF components on the p.c.b., the first end portion having the fixed value capacitance and the first and second conductors comprise a structure extending substantially orthogonal to the second end portion which comprises printed electrically conductive tracks on a p.c.b. carrying the RF components.

The present invention also provides a radio apparatus having a loop antenna comprising first and second substantially co-extensive electrical conductors having corresponding first and second ends, the first end of the first conductor and the second end of the second conductor providing outputs to RF circuitry of the apparatus.

BRIEF DESCRIPTION OF THE DRAWINGS

The present invention will now be described, by way of example, with reference to the accompanying drawings, wherein.

In the drawings, the same reference numerals have been used to indicate corresponding features.

DETAILED DESCRIPTION OF THE INVENTION

Figure 1:
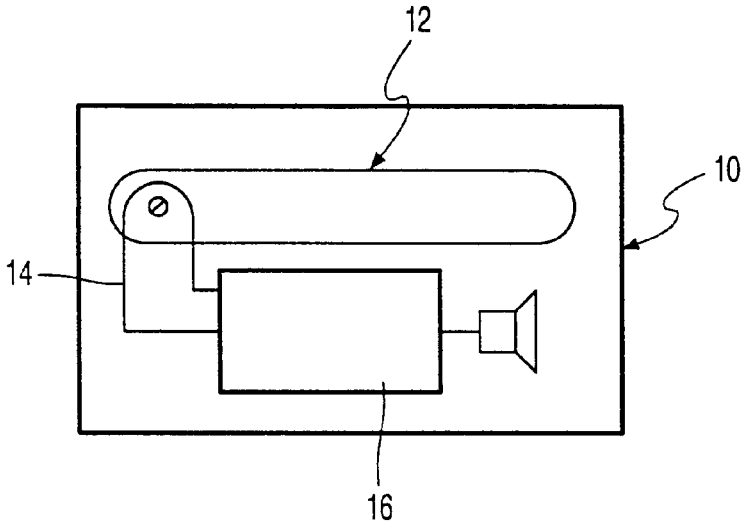
FIG. 1 is a sketch of a radio apparatus made in accordance with the present invention.

Referring to FIG. 1 the radio apparatus comprises a pager 10 having a loop antenna 12 coupled inductively by way of a second loop 14 to RF circuitry mounted on a p.c.b. 16. The details of the RF circuitry and decoder are not relevant to the understanding of the present invention and accordingly will not be described.

Figure 2:
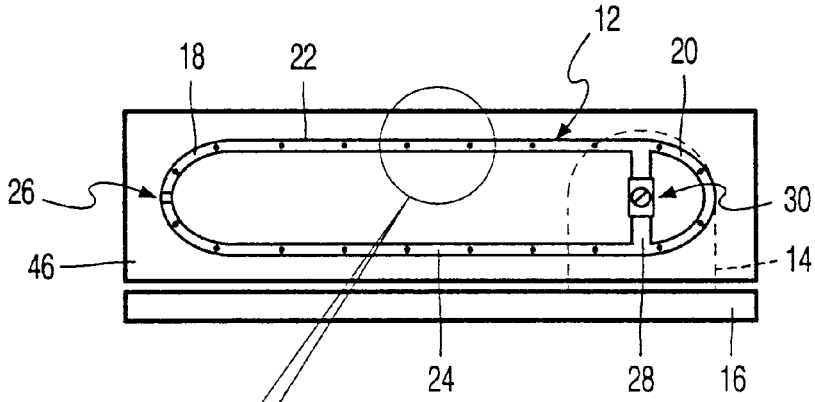
FIG. 2 is a sketch illustrating one embodiment of a loop antenna for use in the radio apparatus shown in FIG. 1.

FIG. 2 illustrates a first embodiment of the loop antenna 12 which may be a self-supporting metal loop or a conductive track on an insulating substrate.

The loop antenna 12 is generally elongate but its exact shape is dependent on the shape of the radio apparatus. The antenna 12 has first and second end portions 18, 20 which are interconnected by first and second conductors 22, 24. A chip capacitor 26 is incorporated in the first end portion 18 and serves to determine the tuning range of the antenna 12. An electrically conductive tap 28 interconnects the first and second conductors 22, 24 adjacent to, but spaced from, the second end portion 20. A mechanically variable capacitor 30 is included in the tap 28 in order to fine tune the antenna 12. The capacitor 26 has a higher Q, at least an order of 10 greater, than the variable capacitor 30. The chip capacitor 26 may for example be a glass or a ceramic capacitor.

The location of the tap 28 is determined empirically having regards to a number of factors. The closer the tap 28 is to the chip capacitor 26 the greater the tuning range but also greater the losses and the closer the tap 28 is to the second end portion 20 the smaller the tuning range but the greater is the efficiency. For the sake of guidance, for an elongate printed circuit loop antenna on a Hi Q substrate having generally flat ends, a length of 35 mm and a width of 9 mm and a frequency of 470 MHz, the tap position of the order of 12 mm from the second end portion was found to be acceptable. The chip capacitor 26 had a value of 2.2 pico-farads and the variable capacitance 30 had a range 1.3 to 3.7 pico-farads.

Figure 3:
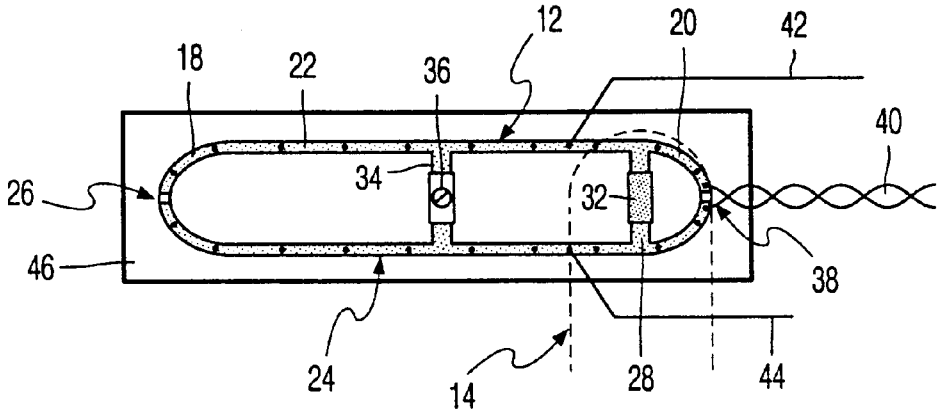
FIG. 3 is a sketch illustrating a second embodiment of a loop antenna for use in the radio apparatus shown in FIG. 1.

FIG. 3 illustrates an electrically tunable loop antenna suitable for a radio apparatus operating on several frequencies. In the interests of brevity only those differences between FIGS. 2 and 3 will be described. The variable capacitance in this embodiment comprises a varactor diode 32 mounted on the tap 28. In order to alter the capacitance of the varactor diode 32, a DC blocking capacitor 38 is incorporated into the second end portion 20 and a bias voltage is applied by twisted conductors 40 to each side of the capacitor 38.

Varactor diodes are generally lossy devices and the lossy effect is minimised by using the high Q chip capacitor 26 to tune the loop antenna 12. In addition a second tap 34 is provided between the first and second conductors 22, 24 at a point adjacent to, but spaced from, the tap 28. A mechanically adjustable capacitor 36 is incorporated into the second tap 34, the capacitor 36 has sufficient tuning range to correct for variations of resonant frequency in manufacture.

As shown the coupling to the RF circuitry is by means of a loop 14. However if a conductive connection is necessary then this may be achieved by wires 42, 44 connected to the first and second conductors 22, 24, respectively, at positions to achieve the required impedance. If convenient the wires 42, 44 may provide the DC bias voltage as well.

Figure 4:
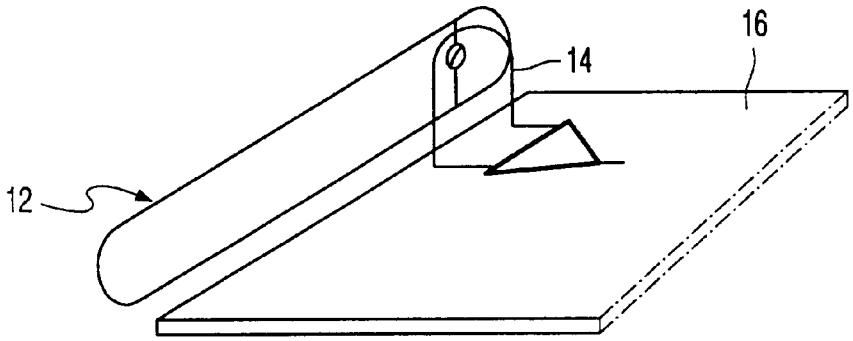
FIG. 4 is a sketch illustrating coupling a loop antenna to a p.c.b. using a magnetic loop coupling.

As mentioned in the description of FIG. 1 and shown more clearly in FIG. 4, the loop antenna 12 can be coupled to the p.c.b. 16 by means of a magnetic coupling loop 14 formed by a length of wire. Advantages of this form of coupling are that the loop antenna 12 is isolated from the p.c.b. 16 and its lossy properties and that the loop antenna 12 can be made separately at a lower cost.

Figure 5:
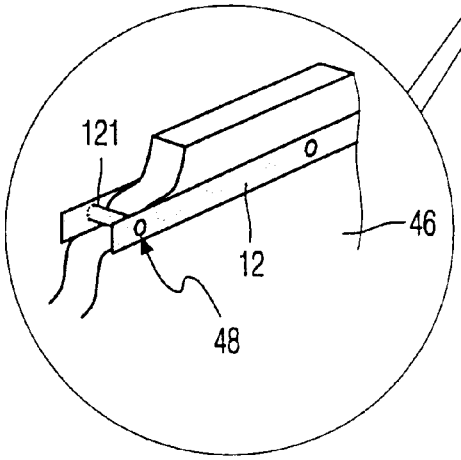
FIG. 5 is an enlarged view of the encircled fragment shown in FIG. 2, FIGS. 6 and 7 are sketches showing double loop arrangements utilising the loop antennas shown in FIGS. 2 and 3, respectively.

Referring to FIG. 5 which is a detail of the encircled fragment of FIG. 2. The loop antenna 12 can be fabricated as a conductive track on one side of a substrate 46, for example by etching directly into p.c.b. laminates or printing a conductive track on a dielectric substrate 46. However the sensitivity of the antenna can be enhanced by providing loop antennas 12, 121 back-to-back on both sides of the substrate 46. Since both sides of the substrate 46 will be at the same potential the E—field in the substrate material will be eliminated and there will be minimal losses.

Depending on the fabrication of the double loop antennas 12, 121, edge effects may adversely affect the above-mentioned advantages, but it has been found that by interconnecting the loop antennas, say by plating through holes 48 in the substrate 46 a Faraday Cage type structure is created which inhibits an E—field within the substrate. Although the holes 48 have been shown in the centre of the conductive tracks, they may be in other positions such as at the marginal areas of the tracks.

Figure 6:
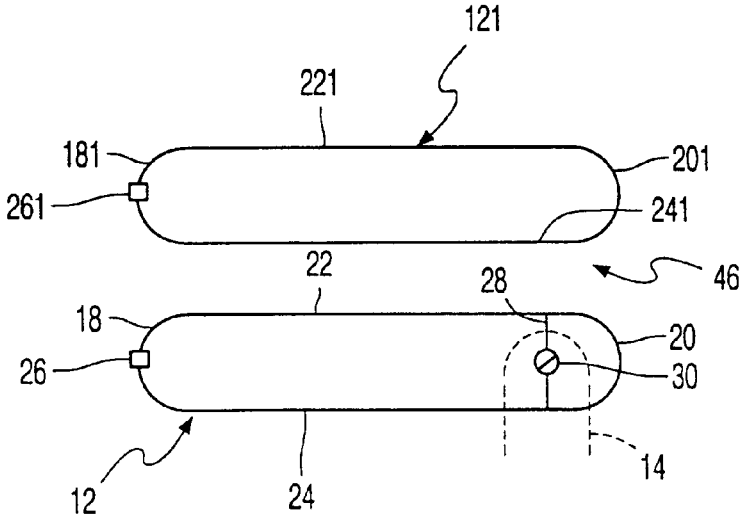
Figure 7:
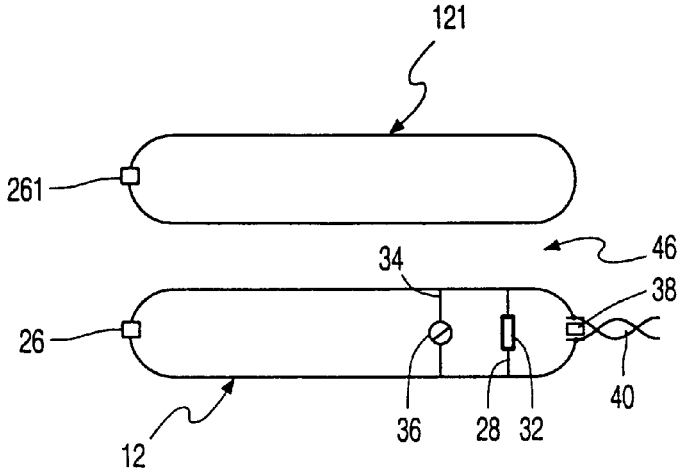

FIGS. 6 and 7 illustrate embodiments of double loop antennas based on the first and second embodiments shown in FIGS. 2 and 3. In the interests of clarity the substrate 46 has been referenced but not shown. The loop antenna 121 in FIGS. 6 and 7 is of the same shape and size as the respective loop antenna 12 and has a chip capacitor 261 in its first end portion 181 but does not have a variable capacitance on a tap bridging the first and second conductors 221, 241 in order to simplify the tuning of the antenna.

Figure 8:
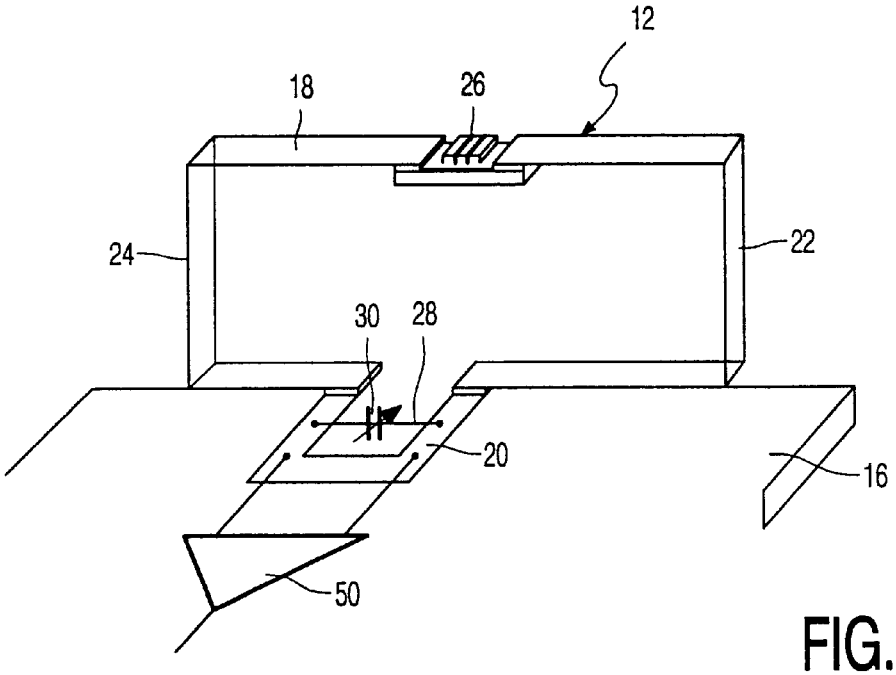
FIG. 8 is a sketch illustrating a third embodiment of a loop antenna.

FIG. 8 illustrates an embodiment of a loop antenna 12 in which the second end portion 20 and the tap 28 with a mechanically variable capacitor 30 are carried by a p.c.b. 16 with rest of the loop antenna extending substantially orthogonally to the p.c.b. 16. More particularly the first end portion 18 together with the first and second conductors 22, 24 are of a low loss material, for example silver plated copper. It is possible for the second end portion 20 to be made from the same material as the remainder of the loop antenna. The high Q—capacitor 26 is inserted into a break in the first end portion and is used to tune the loop above the wanted channel frequency. The capacitor 26 may be fabricated as a small p.c.b. with appropriate plating and a low loss substrate, for example a pffe loaded substrate, or may be a high Q fixed capacitor mounted on the small p.c.b. The second end portion 20 comprises copper tracks on the p.c.b. and the mechanically adjustable capacitor 30 has a value to pull the resonance of the overall loop antenna onto the required frequency. The second end portion 20 of the loop antenna 12 is used to inductively tap into the remainder of the loop to obtain the required impedance transformation for matching into a low noise amplifier 50.

The Q of the resultant network is higher because the mechanical adjustable capacitor 30 is across a low impedance section of the loop antenna 12, and the equivalent parasitic resistance of this capacitor 30 is transformed up in value by the ratio of the impedance across the high Q capacitor 26 to the impedance at the junctions of the second end portion 20 with the rest of the loop antenna 12, when referred across the antenna. The capacitance of the capacitor 30 is similarly transformed in value and therefore appears as a lower capacitance but higher Q device across the ends of the loop antenna 12.

Another means of constructing a relatively small antenna using low cost components is to fabricate the antenna from a transmission line. The antenna can be made smaller provided that the Q of the detection system rises to compensate for reductions in electrical size. Typical Q values for transmission line resonators are much higher than can be obtained with normal lumped impedance circuits.

Figure 9:
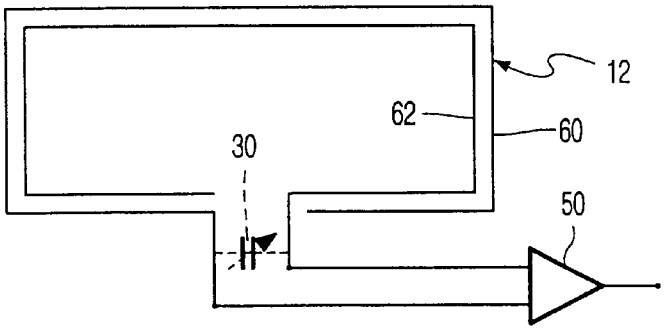
FIG. 9 is a sketch of a loop antenna fabricated from transmission line.

FIG. 9 illustrates an example of a loop antenna comprising parallel arranged transmission lines 60, 62 bent to form loops the opposite end of each being coupled to a respective input of an amplifier 50. The transmission lines 60, 62 act as transmission line transformers which couple magnetically to a radiation field and thereby act as an antenna. Tuning of the antenna is dependent on the well—controlled parameter of transmission line length so that it is possible to manufacture antennas ready tuned to the frequency of interest.

Optionally a mechanically adjustable capacitor 30 may be provided to trim the tuning of the antenna. Implementations of the transmission line antennas may comprise:

(1) a multi-turn helix of co-axial cable with the inner conductor of one end connected to the outer conductor or conductive sheath at the other end and outputs taken from the outer at the one end and the inner conductor at the other end;

(2) a capacitor—like foil spiral wound component comprising two electrically conductive foils interleaved by a dielectric. The inner end of one foil is connected to the outer end of the other foil and outputs are derived from the inner end of the other foil and the outer end of the one foil; and (3) stripline structures for p.c.b. or semiconductor fabrications.

From reading the present disclosure, other modifications will be apparent to persons skilled in the art. Such modifications may involve other features which are already known in the design, manufacture and use of radio apparatus and loop antennas therefor and which may be used instead of or in addition to features already described herein

What is claimed is:

1. A radio apparatus having an loop antenna comprising a generally elongate loop formed by first and second electrical conductors interconnected by first and second electrically conductive end portions, a fixed value capacitance incorporated into the first end portion, a tap interconnecting the first and second conductors adjacent to, but spaced from, the second end portion and a variable capacitance in said tap.

2. An apparatus as claimed in claim 1, characterised in that the fixed value capacitor has a higher Q than the variable capacitance.

3. An apparatus as claimed in claim 1, characterised in that the variable capacitance comprises an electrically adjustable capacitance.

4. An apparatus as claimed in claim 3, characterised by another tap interconnecting the first and second conductors adjacent to, but spaced from, the first mentioned tap, and a mechanically adjustable capacitor in the another tap.

5. An apparatus as claimed in claim 1, characterised in that the loop antenna comprises a substrate and in that the first and second conductors and the first and second end portions comprise a printed electrically conductive track on the substrate.

6. An apparatus as claimed in claim 5, characterised by another generally elongate loop formed by first and second printed electrically conductive tracks interconnected by first and second electrically conductive end portions on the opposite of the substrate to the first mentioned loop, and by a fixed value capacitance incorporated into the first end portion of the another loop.

7. An apparatus as claimed in claim 6, characterised in that the electrically conductive tracks on both sides of the substrate are electrically interconnected by connections through the substrate.

8. An apparatus as claimed in claim 1, characterised in that the first and second conductors and the first end portion extend substantially orthogonally to the second end portion.

9. An apparatus as claimed in claim 1, characterised in that the loop antenna is inductively coupled to another loop mounted on a circuit board carrying RF components.

10. A loop antenna comprising a generally elongate loop formed by first and second electrical conductors interconnected by first and second electrically conductive end portions, a fixed value capacitance incorporated into the first end portion, a tap interconnecting the first and second conductors adjacent to, but spaced from, the second end portion and a variable capacitance in said tap.

* * * * *